United States Patent [19]

Kashio

[11] 4,045,952

[45] Sept. 6, 1977

[54] ELECTRONIC TIMEPIECE APPARATUS

[75] Inventor: Toshio Kashio, Tokyo, Japan

[73] Assignee: Casio Computer Co., Ltd., Tokyo, Japan

[21] Appl. No.: 663,295

[22] Filed: Mar. 3, 1976

[30] Foreign Application Priority Data

Mar. 8, 1975 Japan ..... 50-28278

[51] Int. Cl.[2] ..... G04B 27/00; G04C 3/00

[52] U.S. Cl. ..... 58/23 R; 58/85.5

[58] Field of Search ..... 58/23 R, 85.5

[56] References Cited

U.S. PATENT DOCUMENTS

| | | | |
|---|---|---|---|
| 3,895,486 | 7/1975 | Hammer et al. | 58/23 R |
| 3,914,931 | 10/1975 | Tsuruishi | 58/23 R |
| 4,015,419 | 4/1977 | Morokawa et al. | 58/23 R |

*Primary Examiner*—Stanley J. Witkowski
*Attorney, Agent, or Firm*—Flynn & Frishauf

[57] ABSTRACT

An electronic timepiece apparatus which comprises an electronic time-counting circuit including an oscillator generating standard clock pulses; time-setting means including an actuating switch for correcting the value of a count made by the electronic time-counting circuit; means for correcting the value of a count made by the electronic time-counting circuit for each prescribed period in accordance with the amount and direction of correction determined as the result of comparison by the time-setting circuit between a given point of time and the correct time; and display means for indicating a given point of time just counted by the electronic time-counting circuit.

4 Claims, 1 Drawing Figure

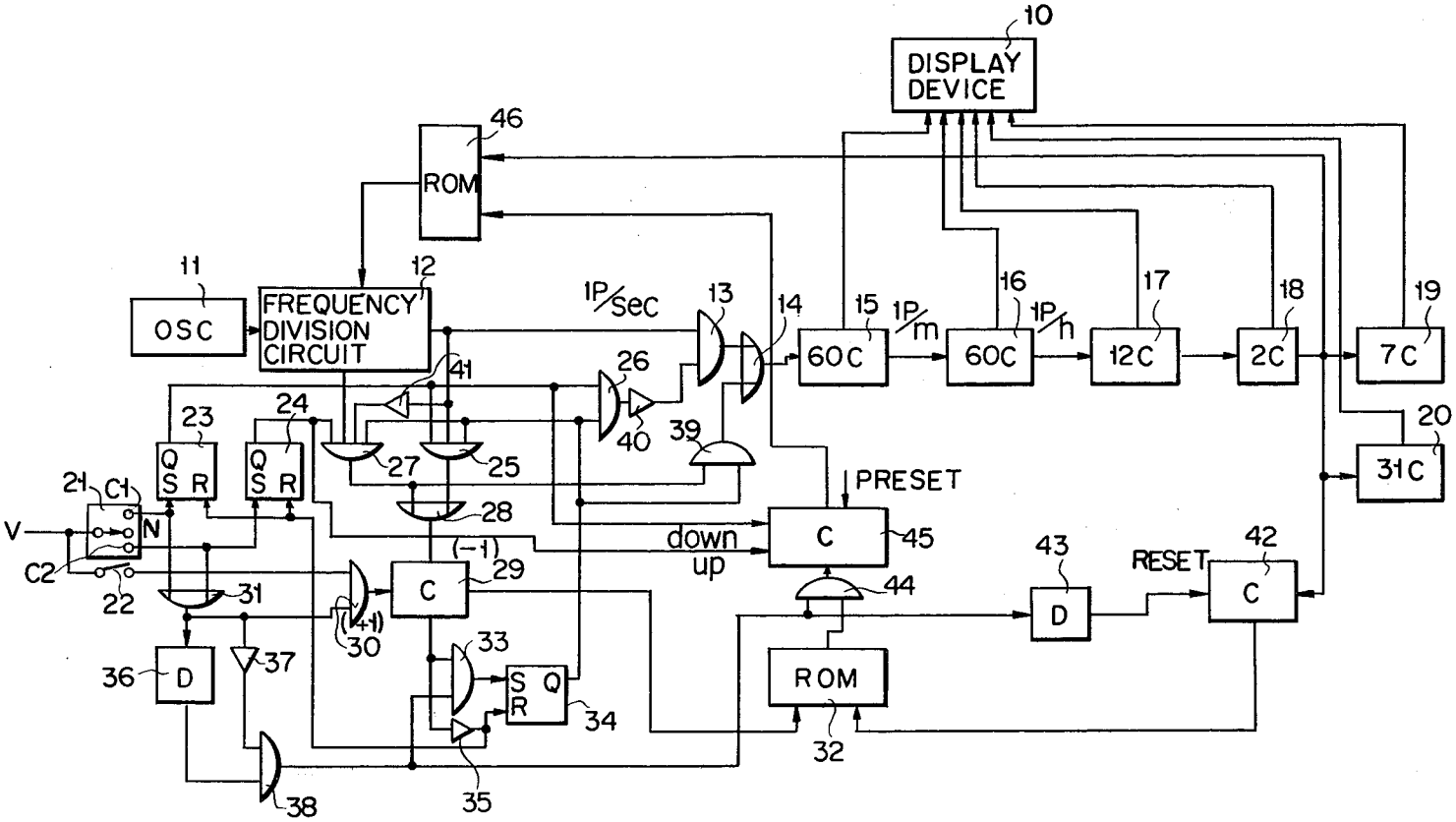
DISPLAY DEVICE
7C
31C
2C
12C
60C
60C
C
C
D
ROM
ROM
OSC
FREQUENCY DIVISION CIRCUIT
Q S R
Q S R
Q S R
D
RESET
PRESET
down
up
1P/sec
1P/m
1P/h
(-1)
(+1)
C1
C2
N
V

ELECTRONIC TIMEPIECE APPARATUS

This invention relates to an electronic timepiece apparatus capable of not only correcting gain and loss, but also storing the amount and direction of actually effected correction and automatically carrying out future correction from the stored data.

Hitherto, an electronic timepiece apparatus has been proposed which electronically generates time-counting clock pulses, counts said clock pulses to form time signals and indicates time, for example, in digits according to said time signals. For accurate operation of such timepiece apparatus, it has been considered advisable to fix the frequency of clock pulses exactly to the predetermined level and oscillate clock pulses under stable condition. Where, however, a clock pulse oscillator is acutally constructed, it is difficult accurately to prescribe a desired oscillation frequency due to different properties of the constituent parts of the clock oscillator. To date, therefore, adjustment of oscillation frequency has been undertaken by means of, for example, a trimmer capacitor. However, required high precision of said adjustment has consumed a great deal of time and work. Moreover, however accurately such adjustment may be attempted, some errors still remain. Further, changes in ambinet temperature also give rise to errors. Therefore, it is impossible to attempt to eliminate errors in the frequency of a clock pulse oscillator merely by any improvement of itself.

It is accordingly the object of this invention to provide an electronic timepiece apparatus capable of not only correcting errors associated with gain and loss, but also automatically correcting the content of a count made by an electronic time-counting circuit for each prescribed period according to the amount and direction of correction actually effected, thereby minimizing errors in the counting of time.

SUMMARY OF THE INVENTION

According to an aspect of this invention, there is provided an electronic timepiece apparatus, which comprises an oscillator generating standard clock pulses; electronic time counting means for counting time by the frequency division of clock pulses produced by the clock pulse oscillator; display means for indicating time according to signals sent forth from the electronic time counting means; memory means for storing a correcting amount by which errors in the frequency of the clock pulse oscillator are to be corrected; control means for readjusting the counting period of the electronic time counting means according to said correcting amount; actuating switch means for correcting the time; time correction control means for changing the time upon operation of said actuating switch means;

time period counting means for counting the time period between a time-correcting operation initiated by the actuating switch means and the immediately preceding time-correcting operation;

means for obtaining an amount of correction for a unit length of time based on the count value of the time period counting means and the period of time by which the time has been changed by the correction control means; and means for changing the amount of correction stored in the memory means as a function of the obtained amount of correction for a unit lenght of time.

BRIEF DESCRIPTION OF THE DRAWING

This invention can be more fully understood from the following detailed description when taken in conjunction with the accompanying drawing, in which:

The appended drawing is a block circuit diagram of an electronic timepiece apparatus embodying this invention.

DETAILED DESCRIPTION

A standard clock pulse having a frequency of, for example, 32,768 Hz which is generated by an oscillator 11 is supplied to a frequency division circuit 12. One input terminal of an AND gate 13 receives one "second" pulse (1P/sec) for each second from the frequency division circuit 12. The other input terminal of the AND gate 13 is connected to the output terminal of an inverter 40. When not supplied with an input, the inverter 40 generates an output 1 which opens the AND gate 13. The above-mentioned 1P/sec signal delivered from the frequency division circuit 12 is conducted to a 60-scale "second" counter 15 through an OR gate 14. A carry signal issued per minute from the "second" counter 15 is counted by a 60-scale "minute" counter 16, which in turn gives off one carry signal per hour. A carry signal from the "minute" counter 16 is transmitted to a 12-scale "hour" counter 17, which in turn sends forth one carry signal for every 12 hours. If, therefor, one carry signal from the "hour" counter 17 is taken to denote the morning or AM, then the succeeding carry signal represents the afternoon or PM. A carry signal from the "hour" counter 17 is supplied to a binary counter 18, which in turn produces one carry signal for every 24 hours or 1 day. A carry signal from the binary counter 18 is conducted to a 7-scale counter 19 and a 31-scale counter 20. A count made by the 7-scale counter 19 denotes the day of the week and a count made by the 31-scale counter 20 represents the day of the month. Signals showing the counts made by the counters 15, 16, 17, 18, 19, 20 are delivered to a display device 10 (including a decoder and driver) to indicate the second, minute, hour, day of the week and day of the month corresponding to the respective counts.

The electronic timepiece apparatus of this invention comprises not only the above-mentioned fundamental electronic time counting circuit but also first and second time-correcting switches 21, 22. The first switch 21 comprises a fixed contact C1 for giving a loss-correcting instruction, a fixed contact C2 for sending forth a gain-correcting instruction and a changeover switch for shifting a neutral position N, to said fixed contact C1 or C2 and is normally set at a neutral position. A signal from a power source V is conducted to the contact C1 or C2 selectively thrown in. The second switch 22 is formed of a normally open switch, which is repeatedly closed and opened in the same number of times as, for example, the number of seconds by which time should be corrected, thereby generating pulses in a number corresponding to a corrected amount of seconds.

The fixed contacts C1, C2 of the first time-correcting switch 21 are connected to the set terminals of flip-flop circuits 23, 24 respectively.

The flip-flop circuit 23 or 24 is selectively operated according to the manner in which the operation of the time-correcting switch 21 is changed over. A set output from the flip-flop circuit 23 is supplied as a gate signal to AND circuits 25, 26. A set output from the flip-flop circuit 24 is brought as a gate signal to an AND circuit 27. Outputs from the AND circuits 25, 27 are transmitted as an advance signal of −1 to a first counter 29 through an OR circuit 28. This first counter 29 makes an advance of +1 upon receipt through an AND circuit 30 of a pulse given off each time the second time-correcting switch 22 is operated. The AND circuit 30 has its gate opened by an output from an OR circuit 31 which is supplied with signals from the fixed contacts C1, C2 of the first time-correcting switch 21. A count signal from the first counter 29 is carried to a read-only memory (abbreviated as "ROM") 32. While stored with a count (other than zero), the counter 29 produces an output. A count output from said counter 29 (hereinafter referred to as "a count detection signal") is conducted to the set terminal of a flip-flop circuit 34 through an AND circuit 33. The count detection signal output terminal of the first counter 29 is connected to an inverter 35, an output from which is supplied to the reset terminal of the flip-flop circuits 23, 24, 34 respectively to reset them when the first counter 29 makes a count of 0.

An output from the OR circuit 31 is brought to a delay circuit 36 and inverter 37. Outputs from said delay circuit 36 and inverter 37 are delivered to an AND circuit 38, which generates a pulse having a width corresponding to a time of delay provided by the delay circuit 36 when the OR circuit 31 ceases to produce an output. Said output pulse from the AND circuit 38 is supplied as a gate signal to the AND circuit 33.

When set, the flip-flop circuit 34 sends forth a gate signal to the AND circuits 25, 26, 27, 39. The AND circuit 39 transfers an output from the AND circuit 27 to an electronic time-counting circuit through the OR circuit 14. The output terminal of the AND circuit 26 is connected to an inverter 40, a 1 output from which opens the gate of the AND circuit 13. The AND circuit 25 is supplied with one pulse per second (1P/sec) from the frequency division circuit 12 for the counting of time. The AND circuit 27 receives not only an output from an inverter 41 of said 1P/sec time-counting signal generated by the frequency division circuit 12 but also a pulse having a higher frequency than said 1P/sec signal.

The ROM 32 is supplied with an output count signal from a counter 42 for counting a carry signal delivered from the binary counter 18. The ROM 32 receives a count signal from the counter 42 which counts a carry signal sent forth from the counter 18. The counter 42 is reset by an output from a delay circuit 43 which receives an output from the AND circuit 38. The counter 42 is already stored with the number of days which have passed since time was previously corrected. The ROM 32 is stored with a corrected amount per unit period of time, for example per day determined from a count output from the counter 42 corresponding to a number of past days and a count output from the counter 29 with respect to, as later described, various output from the counters 29, 42, and issues a signal denoting a required amount of daily correction. An output from the ROM 32 is conducted to a second counter 45 to increase or decrease its count through an AND circuit 44 whose gate is opened by an output from the AND circuit 38. The second counter 45 is preset at a prescribed value. A set output from the flip-flop circuit 23 is supplied as a downcounting instruction to the second counter 45, and a set output from the flip-flop circuit 24 is delivered as an upcounting instruction to said second counter 45. This second counter 45 is finally stored with a count arrived at by adding to the preset value a count corresponding to a signal from the AND circuit 44 or subtracting said count from the preset value is accordance with the content of said down- or up-counting instruction.

A count made by the second counter 45, together with time-indicating signals from the counters 16, 17, 18, is supplied to another ROM 46. The ROM 46 detects and stores a count made by the second counter 45 for every 5 minutes upon receipt of a carry signal from, for example, the counter 18. Pulses sent forth from the corresponding frequency-dividing stage of the frequency division circuit 12 are increased or decreased by a prescribed extent in accordance with said detected count. The above-mentioned 5-minute detection is repeated 288 times per day at the rate of 12 times per hour ($12\times24=288$) in order to examine 5-minute counting on the "minute" counter 16 corresponding to the respective hourly countings on the "hour" counters 17, 18.

Now let it be assumed in this connection that the quartz oscillator 11 presents an error of 60 seconds of each month (taken to have 30 days). Then said error amounts to 2 seconds per day. Further, let it be supposed that an electronic timepiece apparatus is originally designed to carry out the 5-minute correction in units of 0.01 sec. Then, correction of an error of 2 seconds per day requires said unit correction amount of 0.01 sec. per 5 minutes to be repeated 200 times ($2\div0.01=200$). With an ordinary quartz oscillator, an error of 2 seconds per day is considered a maximum value. If, therefore, per day correction is made to an extent 200 times the aforesaid unit correction amount of 0.01 sec., then it will well serve the purpose.

This means that correction of 0.01 sec, for every 5 minutes which can be effected 288 times per day fully covers a maximum range of error occurring in the ordinary quartz oscillator. Accordingly, the counter 45 has only to be provided with a capacity to make a count of 200 at maximum. If, in case the counter 45 counts +2, the ROM 46 is designed to supply one pulse to the frequency-dividing stage of the frequency division circuit 12 issuing a 1P/0.01 sec. at the time of 0 hr-00 min. at which the "hour" counter 18 issues a carry signal and also at the 5 minutes later time of 0 hr-05 min. then an advance of 0.02 sec. can be eventually attained. Where the counter 45 counts −2, the ROM 46 produces an output to prevent an output from the 1P/0.01 sec. frequency dividing stage of the frequency division circuit 12 from being supplied to the succeeding frequency dividing stage at the time of 0 hr-00 min. as well as at the time of 0 hr-05 min., thereby effecting a loss of 0.02 sec. per day.

The ROM 46 may be replaced by an up/down counter (not shown). Namely, it is possible to transfer the count of the counter 45 to the up/down counter in response to a carry signal from the "hour" counter 18 and successively increase or decrease the count of the up/down counter in accordance with a 5-minute signal from the "hour" counter 18 and a count detection signal from the up/down counter, thereby increasing or decreasing a count from the frequency division circuit 12 in units of 0.01 sec. each time an up- or down-counting is made. The counter 45 used in the above-mentioned correction process is of the type which makes a count of between +100 and −100. However, the same effect of time correction may be attained by applying a counter 45 which makes a count of 0 to 200 and taking the point of time at which the counter 45 counts 100 as the standard time.

Where a gain or loss is noticed in the time displayed on an electronic timepiece apparatus arranged as described above, the time is corrected by operating the first and second time-correcting switches 21, 22.

For example, where the displayed time shows an advance of 1 second, then the first switch 21 is thrown to the delay side, namely, to the first contact C1 to set the flip-flop circuit 23. Though a signal from the first fixed contact C1 is also supplied to the delay circuit 36 and inverter 37 through the OR circuit 31, the AND circuit 38 does not produce an output while the first switch 21 continues to be thrown in. At this time, an output from the OR circuit 31 is supplied as a gate signal to the AND circuit 30.

Further, the second switch 22 is operated (opened and closed) according to a required amount of correction, while the first switch 21 is thrown to the delay side. For correction of 1 second, the second switch 22 is opened and closed once to generate one pulse. An output pulse from the second switch 22 is supplied as a count-advancing signal to the first counter 29 through the AND circuit 30 whose gate is now opened. As the result, the counter 29 counts 1. A count detection signal from the counter 29 is conducted as a gate signal to the AND circuit 33.

Where the first switch 21 is brought back to a neutral position N while the first counter 29 is preset at a count denoting a required amount of time correction, then the first fixed contact C1 ceases to send forth an output. As the result, the AND circuit 38 generates an output, which passes through the AND circuit 33 to set the flip-flop circuit 34. At this time, both flip-flop circuits 23, 34 are set, the gates of the AND circuits 25, 26 are opened, and the gate of the AND circuit 13 is closed by the inverter 40. A time-counting pulse from the frequency division circuit 12 is delivered as a down-counting signal to the counter 29 through the AND circuit 25 and OR circuit 28. When the frequency division circuit 12 issues one time-counting pulse, the counter 29 makes a count of 0. Accordingly, a count detection signal is extinguished and the inverter sends forth an output, thereby resetting the flip-flop circuits 23, 34. The gates of the AND circuits 25, 26 are closed, and a time-counting pulse from the frequency division circuit 12 is supplied to an electronic time-counting circuit through the AND circuit 13. A number of time-counting pulses from the frequency division circuit 12 which are to be delivered to the electronic time-counting circuit is decreased by a number corresponding to the count of the counter 29, thereby correcting the delay of the displayed time.

At the above-mentioned time correction, the count of the first counter 29 is coupled to the ROM 32, which is also supplied from the counter 42 with a signal denoting a number of days which have passed since time was previously corrected. If a number of said past days indicates 20 and the count of the counter 29 stands at 1, then it means that 1 second has been lost during 20 days. Where, a unit period of time in which time should be corrected is set at 1 day, then it is necessary to carry out a correction of 0.05 sec. per day. If an electronic timepiece apparatus is originally designed to carry out daily correction in units of 0.01 sec., then the required correction amount of 0.05 is equal to 5 times said unit correction amount of 0.01. Therefore, the ROM 32 issues a positive signal of 5. When the AND circuit 38 prodices a signal, the positive signal of 5 from the ROM 32 is transmitted to the second counter 45 through the AND circuit 44. At this time, the second counter 45 is already supplied with a down-counting instruction due to the setting of the flip-flop circuit 23. Therefore, the count of the counter 45 is down counted by 5 in response to a signal from the ROM 32. If the counter 45 has been preset at 0 up to this point, then the counter 45 is freshly preset at a count of −5. A signal from the AND circuit 38 passes through the delay circuit 43 to the counter 42 to reset it. As the result, said counter 42 is made ready to count the number of days which will pass until the succeeding time correction is carried out.

Where an electronic timepiece apparatus is originally designed to carry out daily time correction at the rate of 0.01 sec. for every 5 minutes, Table 1 below shows that amount of daily correction delivered from the ROM 32 to the counter 45 at which said counter 45 is to be preset per day based on the number of days during time correction should be effected once as well as on the frequency at which the time-correcting switch 22 is repeatedly operated (namely, the number of seconds denoting the total amount of time correction required during the above-mentioned number of days).

Table 1

| Number of days past \ Operation frequency | 1 | 2 | 3 | 4 | 5 |
|---|---|---|---|---|---|
| 10 | 10 | | | | |
| 11 | 9 | | | | |
| 12 | 8 | | | | |
| 13 | 7 | | | | |
| 14 | 7 | | | | |
| 15 | 6 | | | | |
| 16 | 6 | | | | |
| 17 | 6 | | | | |
| 18 | 5 | | | | |
| 19 | 5 | 10 | | | |
| 20 | 5 | 10 | | | |
| 21 | 5 | 10 | | | |
| 22 | 5 | 9 | | | |
| 23 | 4 | 9 | | | |
| 24 | 4 | 9 | | | |
| 25 | 4 | 8 | | | |
| 26 | 4 | 8 | | | |
| 27 | 4 | 8 | | | |
| 28 | 4 | 7 | | | |
| 29 | 4 | 7 | 10 | | |
| 30 | 3 | 7 | 10 | | |
| 31 | 3 | 6 | 10 | | |
| 32 | 3 | 6 | 9 | | |
| 33 | 3 | 6 | 9 | | |
| 34 | 3 | 6 | 9 | | |
| 35 | 3 | 6 | 9 | | |
| 36 | 3 | 5 | 8 | | |
| 37 | 3 | 5 | 8 | | |
| 38 | 3 | 5 | 8 | 10 | |
| 39 | 3 | 5 | 8 | 10 | |
| 40 | 2 | 5 | 8 | 10 | |
| 41 | 2 | 5 | 7 | 10 | |
| 42 | 2 | 5 | 7 | 9 | |
| 43 | 2 | 5 | 7 | 9 | |
| 44 | 2 | 5 | 7 | 9 | |
| 45 | 2 | 4 | 7 | 9 | |
| 46 | 2 | 4 | 7 | 9 | |
| 47 | 2 | 4 | 6 | 8 | |
| 48 | 2 | 4 | 6 | 8 | 10 |
| 49 | 2 | 4 | 6 | 8 | 10 |
| 50 | 2 | 4 | 6 | 8 | 10 |
| 51 | 2 | 4 | 6 | 8 | 9 |
| 52 | 2 | 4 | 6 | 8 | 9 |
| . | . | . | . | . | . |
| . | . | . | . | . | . |
| . | . | . | . | . | . |

Table 1 presents different multiples of a unit amount of 5-minute correction, namely, 0.01 sec., which are stored in the ROM 32 according to the values of outputs from the counters 29, 42. Now let it be assumed that 2 seconds should be corrected during, for example, 20 days which have passed since that end of the preceding time correction period. Then the required daily amount of corrections is 0.1 sec., and consequently the ROM 32 supplies the counter 45 with a count of 10, because, as described above, the electronic timepiece apparatus is originally designed to carry out daily time correction in units of 0.01 sec. Table 1 represents the case where an ordinary quartz oscillator is taken to make an error of about 3 seconds per month. The above-mentioned value at which the counter 45 is preset enables the ROM 32 to serve the purpose even with an extremely small capacity.

If it is desired to elevate the operating precision of an electronic timepiece apparatus, said apparatus should advisably be designed to correct time in smaller units than 0.01 sec. Where a unit period of time during which time correction should be undertaken has, for example, fewer days than 19 and the time-correcting switch has only to be operated, for example, twice or less frequently, then a correction amount of 10 may be allotted to each blank portion of Table 1 under the item of 2 denoting the operating frequency of said time-correcting switch which corresponds to any shorter period than 19 days. A similar description is applicable to the other blank portions of Table 1.

The counter 45 is stored with a required count amount of time correction per unit period of time, for example, per day. The count amount stored in the counter 45 is read out to another ROM 46, for example, for every 5 minutes upon receipt of a carry signal from the counter 18 and a count output supplied every 5 minutes from the "minute" counter 16, thereby, as previously mentioned, correcting a count obtained from the 1P/0.01 sec. frequency-dividing stage of the frequency division circuit 12. Since the counter 45 is preset at a count of −5, as previously described, five 1P/0.01 sec. signals are deleted from the frequency division circuit 12 for every 5 minutes to effect a delay of 0.05 sec. per day. The subsequent time-correction data is stored in the counter 45, thereby automatically carrying out the succeeding time correction of delaying 1 second during 20 days at the same per day rate as previously attained by operation of the time-correcting switches 21, 22.

Where a displayed time indicates a delay, said delay is corrected similarly by the first and second time-correcting switches 21, 22. In this case, correction for an advance is undertaken in the following way. The first time-correcting switch 21 is thrown to the second fixed contact C2 to set the flip-flop circuit 24 and supply a gate signal to the AND circuit 30 through the OR circuit 31. The first counter 29 is stored with a required amount of correction by operation of the second time-correcting switch 22. Where, under this condition, the first time-correcting switch 21 is brought back to a neutral position N, then an output from the AND circuit 38 sets the flip-flop circuit 34 to open the gate of the AND circuit 27. Accordingly, the frequency division circuit 12 produces a pulse having a shorter period than 1P/sec. through the AND circuit 27. Said pulse is conducted to a time counting circuit through the AND circuit 39 and OR circuit 14 to correct a displayed time for an advance. At this time, a pulse used for an advance is counted by the first counter 29. The flip-flop circuit 34 is reset when the number of counted pulses coincides with a prescribed amount of correction already stored in the first counter 29, thus terminating the abovementioned correcting operation. Since, at this time, the gate of the AND circuit 27 is controlled by the inverter 41, a correction pulse corresponding to a 1P/sec. time-counting signal issued from the frequency division circuit 12 ceases to be sent forth from the AND circuit 39.

At the above-mentioned correction for a gain, too, the ROM 32 is coupled with the count of the first counter 29, as well as with that of the counter 42. As the result, the counter 45 is supplied through the AND circuit 44 with a determined amount of time correction per unit period of time, for example, per day. Since, at this time, the flip-flop circuit 24 is set, the counter 45 is making up-counting. Thus the frequency division circuit 12 is controlled for an advance by the ROM 46 for each unit period of time, for example, per day.

Each time a total required amount of correction is determined for a given period consisting of a number of days, said amount of correction is divided into a daily requirement of correction. Later, daily correction is automatically effected for each unit period of time. An amount of said daily correction in successively added to that already stored in the second counter 45, thus progressively decreasing an error of time indication.

With an electronic timepiece apparatus arranged as described above, errors in the frequency of, for example, a quartz oscillator 11 can be corrected while time is counted per unit period of time, for example, per day, through repetition of time-correcting operations, thus attaining extremely accurate time counting. Since said errors are corrected not by, for example, a trimmer condenser used for the fine adjustment of an oscillation member itself, but by an ordinary process of time correction, adjustment of said oscillation member constituting a very important part of an electronic timepiece apparatus can be easily effected, offering the noticeable advantage of not only simplifying the construction of an electronic timepiece apparatus, but also elevating the precision of time counting.

With the foregoing embodiment, a unit period of time in which required time correction was to be carried out was represented by 1 day, and the electronic timepiece apparatus was designed to carry out time correction in units of 0.01 sec. Of course, these factors can be freely chosen. Further, the first and second switches were used as means for correcting time. However, any other process may be applied with the same effect, provided it can determine an advance or delay and a required amount of time correction. For example, it is possible to apply a different time-correcting process of depressing a single time-correcting switch for an advance before 30 seconds are counted and for a delay after 30 seconds are counted, thereby effecting time correction for a gain or loss by means of a single time-correcting switch and determining a required amount of correction according to the operating frequency of said switch. Further, it is possible to provide two time-correcting switches, use one of them exclusively to carry out a gain and determine a required amount of said gain and apply the other exclusively to effect a loss and define a required amount of said loss.

With the foregoing embodiment, the counter 29 was stored with a count denoting the operating frequency of the second time-correcting switch 22. However, a different kind of pulse, for example, 1p/2 sec. pulse may be supplied as a gain advance signal to the counter 29 in accordance with the operating period of the second time-correcting switch 22. This invention is also applicable to a process which operates one time-correcting switch in exact timing with, for example, a braodcast announcement of time, considers 0 to 30 seconds displayed at said time setting as a gain, clears said "second" counter, regards 31 to 59 seconds presented at said time setting as a loss, and concurrently increases the "minute" counter by one, and clears the "second" counter. This invention can obviously be practiced with various modifications without departing from the object and scope of the invention including the matters particularly described herein in connection therewith.

What is claimed is:

1. An electronic timepiece comprising:

an oscillator for generating standard clock pulses;

electronic time counting means coupled to the oscillator for frequency-dividing and counting the clock pulses from the oscillator;

display means coupled to the electronic time counting means for indicating the time in accordance with a signal from the electronic time counting means;

memory means for storing an amount of correction by which to correct the error in the frequency of the standard clock pulses from the oscillator;

control means coupled to the electronic time counting means for adjusting the counting period of the electronic time counting means as a function of the amount of correction stored in the memory means;

actuating switch means for correcting the time;

time correction control means coupled to the actuating switch means for changing the time upon operation of the actuating switch means;

time period counting means for counting the time period between a time-correcting operation initiated by the actuating switch means and the immediately preceding time-correcting operation;

means for obtaining an amount of correction for a unit length of time based on the count value of the time period counting means and the period of time by which the time has been changed by the correction control means; and means for changing the amount of correction stored in the memory means as a function of the obtained amount of correction for a unit length of time.

2. An electronic timepiece according to claim 1, wherein said means for changing the amount of correction stored in the memory means includes means for receiving a signal denoting the direction of correction from said time correction control means; and means for increasing or decreasing the amount of correction in said memory means to a specific degree in accordance with said received signal.

3. An electronic timepiece according to claim 1, wherein said means for changing the amount of correction stored in the memory means includes means for receiving a signal denoting the direction of correction and the amount of correction from said time correction control means; and means for changing the amount of correction stored in said memory means in accordance with said received signals.

4. An electronic timepiece according to claim 1, wherein said actuating switch means includes a first switch for use when correcting a time gain, and a second switch for use when correcting a time loss.

* * * * *